United States Patent [19]

Kano

[11] Patent Number: 4,698,866

[45] Date of Patent: Oct. 13, 1987

[54] MOBILE BRIDGE STRUCTURE HAVING A PLURALITY OF RAMP MODULES

[75] Inventor: Hisashi Kano, Kobe, Japan

[73] Assignee: Mitsubishi Jukogyo Kabushiki Kaisha, Tokyo, Japan

[21] Appl. No.: 738,308

[22] Filed: May 28, 1985

[30] Foreign Application Priority Data

May 28, 1984 [JP] Japan ..... 59-106416
Jun. 11, 1984 [JP] Japan ..... 59-85491[U]

[51] Int. Cl.[4] ..... E01D 1/00
[52] U.S. Cl. ..... 14/1; 404/1
[58] Field of Search ..... 14/1, 2.4, 71.1, 72.5; 404/1; 104/126; 238/10 R, 1; 414/495, 498; 180/89.13

[56] References Cited

U.S. PATENT DOCUMENTS

| | | | |
|---|---|---|---|
| 648,620 | 5/1900 | Holmes | 14/72.5 X |
| 2,363,767 | 11/1944 | Yassin | 14/1 |
| 3,398,984 | 8/1968 | Ajero | 414/498 X |
| 3,811,147 | 5/1974 | Dix | 14/1 |
| 4,144,979 | 3/1979 | Leach, Jr. et al. | 14/71.1 X |
| 4,235,399 | 11/1980 | Shorey | 14/71.1 X |
| 4,242,032 | 12/1980 | Whiteman et al. | 14/71.1 X |
| 4,348,780 | 9/1982 | Angelo et al. | 14/1 |

FOREIGN PATENT DOCUMENTS

| | | | |
|---|---|---|---|
| 935911 | 11/1935 | Fed. Rep. of Germany | 14/1 |
| 3107408 | 11/1982 | Fed. Rep. of Germany | 14/2.4 |
| 505813 | 5/1939 | United Kingdom | 14/1 |
| 879126 | 11/1961 | United Kingdom | 14/70 |

*Primary Examiner*—James A. Leppink
*Assistant Examiner*—Matthew Smith
*Attorney, Agent, or Firm*—Birch, Stewart, Kolasch, & Birch

[57] ABSTRACT

An improved construction of a movable bridge structure which comprises a plurality of segment block means consisting of at least one self-propelled block means and at least one non-propelled block means adapted to be coupled releasably with the adjacent self-propelled block means, and translating means adapted to have the non-propelled block translated onto and out of the adjacent self-propelled block means. Also, there is provided an improved movable bridge structure, which comprises, in combination, a pair of central bridge element means each having an overhung portion formed integrally with and extending from the front end of a road or ground plate member held on a self-propelled carrier and having a front driving cockpit suspended downwardly and shiftably forwardly and rearwardly from the lower surface of the overhung portion; and a pair of ramp block means including a pair of trailing ramp segment means adapted to be coupled releasably with each of the bridge element means and adapted to be coupled releasably with each pair of ramp segment means, and including a translating device incorporated therein for translating the ramp block means onto and out of the ramp segment means, wherein the leading end of each overhung portion on the part of each central bridge element means is operatively coupled with each other in an opposed relationship so that there is provided a central portion of the bridge structure, whereby there is defined a substantial work space under the ground plate members coupled opposedly together.

5 Claims, 23 Drawing Figures

MOBILE BRIDGE STRUCTURE HAVING A PLURALITY OF RAMP MODULES

BACKGROUND OF THE INVENTION (i) Field of the Invention

The present invention relates generally to a movable bridge, and more particularly to a movable built-up bridge structure for use in the road repairing services.

(ii) Description of the Prior Art

Road repair work generally causes traffic jam or even a complete obstacle for traffic and transportation on a road. In an attempt to cope with such undesired conditions, there has been proposed a movable bridge structure of built-up type which is temporarily installed upon a portion of the road, to be repaired, so that the traffic may be maintained without interruption while the road repair work desired is being continued under such bridge structure.

Conventional movable bridges of this type are, as typically shown in FIGS. 22 and 23, of such a general construction which comprises a central bridge portion (a) equipped with a travelling unit having a working space therein, and a ramp portion (b) either of a hinged type or of a sliding type which may be stored somehow into the central portion for the removal and transportation purposes.

According to the conventional constrution of this type bridge structure, there is a physical restriction such that the slope of a ramp cannot be made too large in order for vehicles to pass smoothly thereover. This type of bridge would require a relatively long extension of the entire bridge structure and the bridge structure cannot be designed with a desired short extension. Bridges of the type have a small height, which creates an inconvenience and difficulty in the repair work under the bridge structure.

Accordingly, it is inevitable in the conventional design of such a movable bridge structure that the whole extension of the central bridge portion (a) would exceed, to a considerable extent, the general length allowed for on-road traffic vehicles which would result in an impracticability of use. On the other hand, if the joint section with the ramp portion (b) is designed to be of a hinged type, and when this is adapted in installation on a road having a certain gradient in the transversal direction, it is inevitable in the operation of this bridge structure that there would occur an undesired torsion or twisting load upon the hinged portion which would eventually result in a weak spot in the structural strength.

Also, it is to be noted that construction of a movable bridge of the type stated above is rather complicated resulting in expensive production costs.

SUMMARY OF THE INVENTION

The present invention is therefore materialized to practice in view of such circumstances and inconveniences as noted above and is essentially directed to the provision of an improved movable bridge structure, which can afford an efficient solution to the above noted problems. According to the entity of the present invention, there is provided, as briefly summarized, an improved construction of a movable bridge structure which comprises a plurality of segment block means consisting of at least one self-propelled block means and at least one non-propelled block means adapted to be coupled releasably with the adjacent self-propelled block means, and translating means adapted to have the non-propelled block translated onto and out of the adjacent self-propelled block means.

Also, according to another embodiment of the invention, there is provided an improved movable bridge structure, as may be summarized in brief, which comprises, in combination, a pair of central bridge element means each having an overhung portion formed integrally with and extending from the front end of a road or ground plate member held on a self-propelled carrier and having a front driving cockpit suspended downwardly and shiftably forwardly and rearwardly from the lower surface of the overhung portion; and a pair of ramp block means including a pair of trailing ramp segment means adapted to be coupled releasably with each of the bridge element means and adapted to be coupled releasably with each pair of ramp segment means, and including a translating device incorporated therein for translating the ramp block means onto and out of the ramp segment means, wherein the leading end of each overhung portion on the part of each central bridge element means is operatively coupled with each other in an opposed relationship so that there is provided a central portion of the bridge structure, whereby there is defined a substantial work space under the ground plate members coupled opposedly together.

By virtue of advantageous constructions as noted above by way of preferred embodiments of the invention, such advantageous effects are attainable in practice that there may be a large work space under the ground plate of a movable bridge structure wherein a central bridge section comprises a pair of central bridge elements each having an overhung portion extending from the front end of a ground plate held in position by a self-propelled carrier, the leading ends of the overhung portions from the opposed central bridge elements being adapted to be coupled with each other in such a manner that the large work space may be made available thereunder. Also, by virtue of an integral structure of the overhung portion with the ground plate held by the self-propelled carrier thereupon, there is attained sufficient structural strength enough to support with stability a substantial traffic volume rendered thereupon, thus allowing a reliable overhung structure in the bridge construction. In addition, owing to the provision of a driver's seat under the overhung portion extending integrally from the front end of the ground plate of the central bridge element in such a manner that the driver's seat may adjustably be shifted back and forth, this can be an efficient measure of dissolution of a poor visibility that is otherwise inevitable from the overhung structure.

Moreover, by the provision of such an advantageous construction that a haul-up type ramp segment forming part of the ramp section may be jointed releasably to each central bridge element, it can exhibit a facility in handling such as in a delivery to or from of a repair work site, an installation and evacuation work, or the like.

Furthermore, in virtue of an efficient constrution such that a translating unit for the haul-up type ramp segment stated above is incorporated in a ramp block connected releasably to the ramp segment which form part of the bridge ramp section, it can afford a facility in the loading and unloading work of the ramp block onto and from the ramp segment without the need for any cumbersome or weighty devices.

Still further, thanks to the divisional construction of a bridge structure into a pair of central bridge elements, a pair of haul-up type ramp segments and a pair of tilt blocks, each of such divisional elements may then be ready for the transportation by way of the normal road free from any restrictions under the traffic regulations, accordingly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein:

FIGS. 12 through 21 are schematic views showing translating unit constructions according to further embodiments of the invention for mounting the ramp block onto a self-propelled bridge element, among which FIG. 12 is a side elevational view showing the same, FIG. 13 is a top plan view thereof, FIG. 14 is a cross-sectional view taken along the line III—III in FIG. 13, FIG. 15 is a cross-sectional view taken along the line IV—IV in FIG. 12, FIGS. 16 through 20 are schematic views showing a sequence of translating work, FIG. 21 is a fragmentary enlarged view showing, in cross section, the detail of the part shown by X in FIG. 20.

DETAILED DESCRIPTION OF THE PREFERRED EMBODIMENTS

Figure 1:
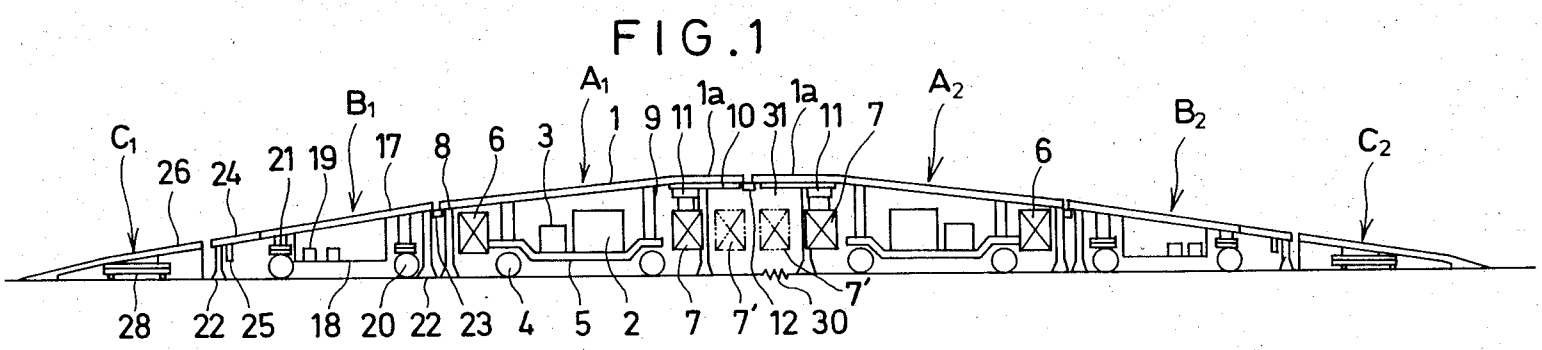
FIG. 1 is a schematic side elevational view showing, by way of a preferred embodiment of the present invention, the general construction of an improved movable built-up bridge structure for the road repairing services according to the invention.

The present invention will now be explained by way of a preferred embodiment thereof as adapted in practice to the movable built-up type bridge structure for use in the road repairing work in reference to the drawings attached herewith. Now, the reference is made to FIGS. 1 through 10, side elevational views of the bridge structure according to the invention, wherein there are shown organizational modules designated at the reference characters $A_1$, $A_2$ which comprise a central bridge element of the bridge structure; modules designated at $B_1$, $B_2$ comprising a haul-up type ramp segment; and modules at $C_1$, $C_2$ comprising a ramp segment, respectively.

According to the construction of the modules $A_1$, $A_2$ shown in these drawing figures, a road plate or ground plate 1 is seen held by a pillar or post 9 upon a carrier frame 5, on which there are mounted a prime mover or engine 2, a hydraulic pump 3 and a rear driving seat 6, and there are also provided traveling wheels 4. In the drawings, there is also shown outriggers designated at the reference numeral 8, which are securely mounted on the ground plate 1.

Extending integrally from the front end of the ground plate 1 is an overhung portion 1*a*, under which there is mounted shiftably downwardly a drive 11, and from this drive there is seen suspended a front driving seat or cockpit 7. Also, there are installed couplers 12, 23 at the front and rear ends of the ground plate 1, respectively.

In these drawings, there is also designated a compressor at 13, a power generator 14, a roller conveyor 15, and a free-action bearing 16, all which are mounted either from the ground plate 1 or the carrier frame 5.

The hydraulic pump 3 noted above is driven from the engine 2, with the generated hydraulic pressure being fed to the hydraulic driving motor mounted from the carrier 5 for driving the traveling wheels 4 so that the modules $A_1$, $A_2$ may be driven for transporting. It is arranged that these wheels 4 may be steered hydraulically according to electric signals from cockpits 6, 7 permiting not only forward and rearward traveling motions but also skewing and turning motions.

While the cockpits 6, 7 for driving the modules $A_1$, $A_2$ are provided as shown in the both front and rear ends of the modules $A_1$, $A_2$, it is designed that the front cockpit 7 can be shifted towards the leading end of the rails 10 as designated at the reference numeral 7' by the driving unit 11 so that good visibility may be obtained during the locating operation of the bridge structure.

Incidentally, the equipment such as the compressor 13, the power generator 14, the roller conveyor 15 and the free-action bearing 16 is provided for use in the traveling operation or during the road repair work.

The modules $B_1$, $B_2$ are adapted to comprise the haul-up ramp segment, which is comprised of a road plate or ground plate designated at 17, a free-action bearing 18 suspended downwardly from the ground plate 17, a housing box 19 mounted upon the free-action bearing 18, a set of wheels 20, and steering masts 21 and outriggers 22 mounted from the ground plate 17. Also shown is a coupler 23' installed on the front end of the ground plate 17, which is adapted to be coupled releasably with a corresponding coupler 23 on the part of the modules $A_1$, $A_2$ stated above. There is also shown a jack 25 installed upon the ground plate 17, and a water tank 32, both implemented during the road repairing services.

The modules $C_1$, $C_2$ are comprised of a ground plate 26 having side boards 27 and a wheeled table lift 28 which forms a translating unit for the ramp segment mounted downwardly from the ground plate 26.

In the drawings, there is also shown a tractor 29 for moving module $B_1$ to a portion of the road under repair work 30.

Figure 3:
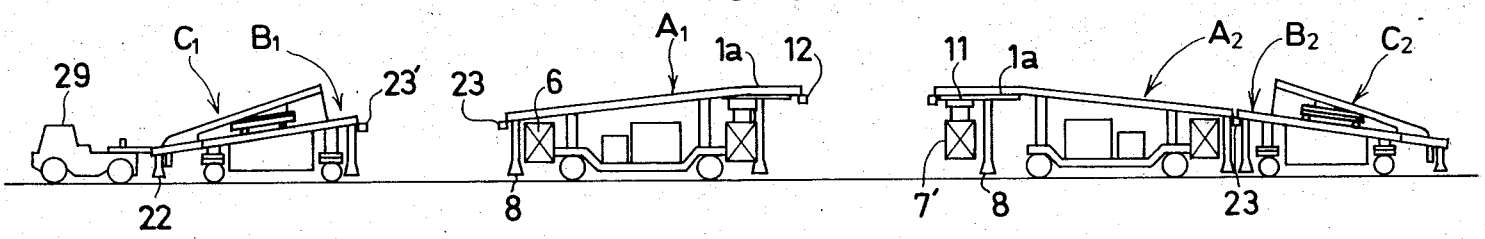
FIGS. 3 and 4 are similar side elevational views to FIG. 1 showing the processes of delivery and installation of the bridge structure.
Figure 4:
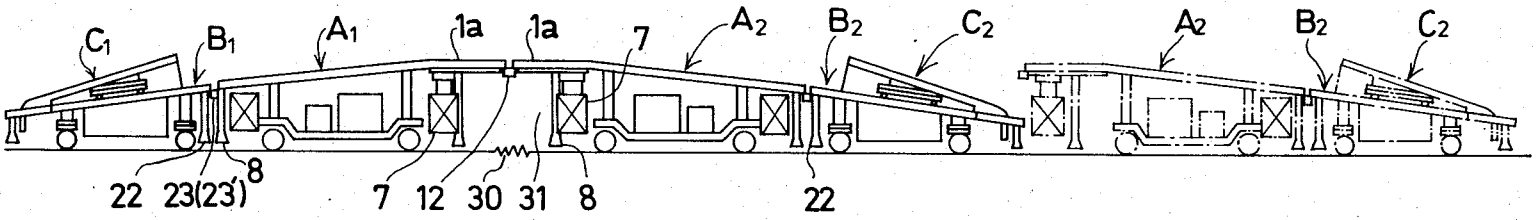

With such construction of the embodiment of the invention shown in these drawings, when it is required to deliver the built-up bridge structure to a working site, it may readily be divided into three blocks as typically shown in FIG. 3.

Figure 8:
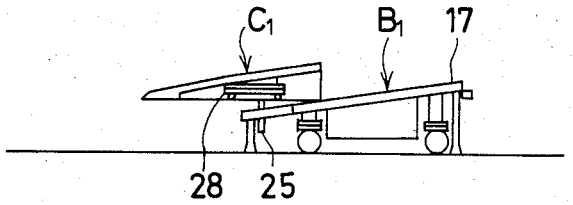
Figure 9:
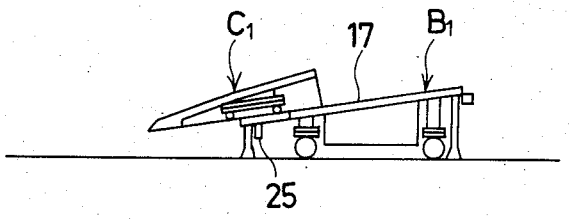
Figure 10:
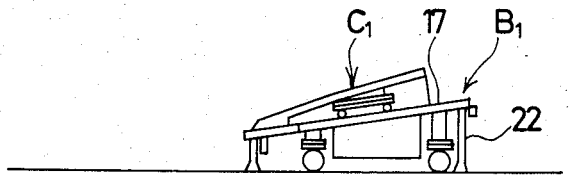
Figure 12:
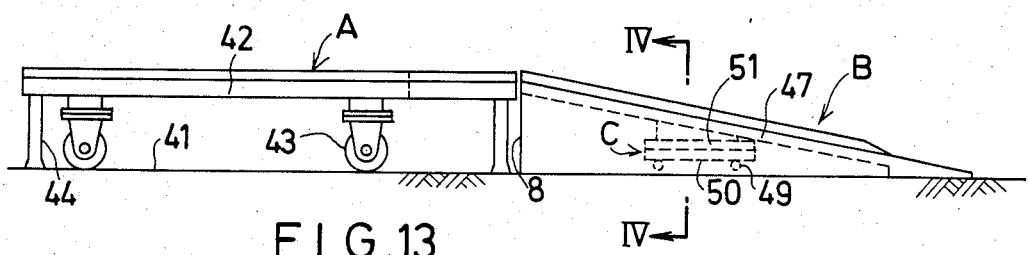
Figure 13:
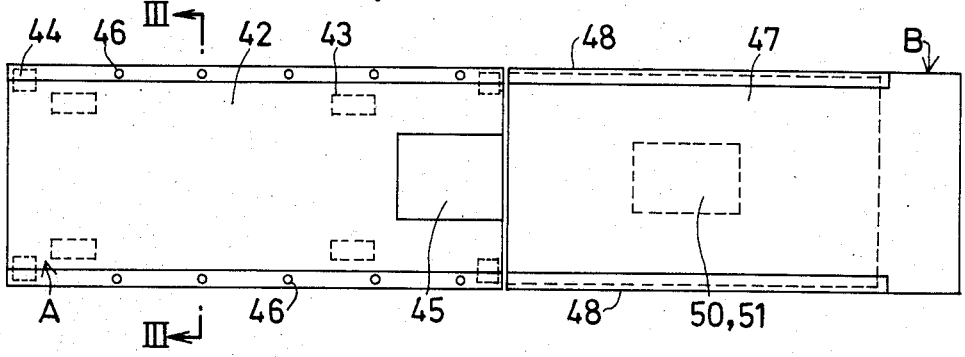
Figure 14:
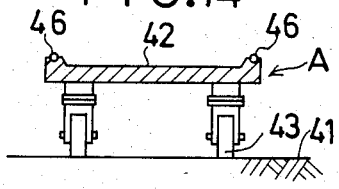
Figure 15:
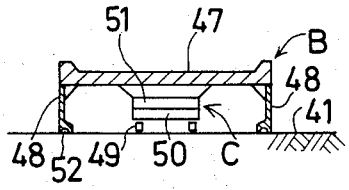
Figure 16:
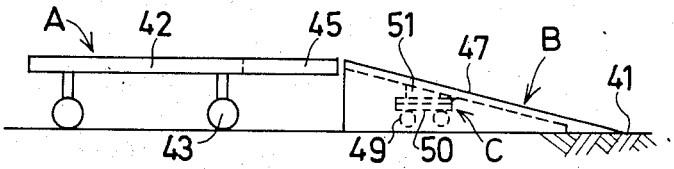
Figure 17:
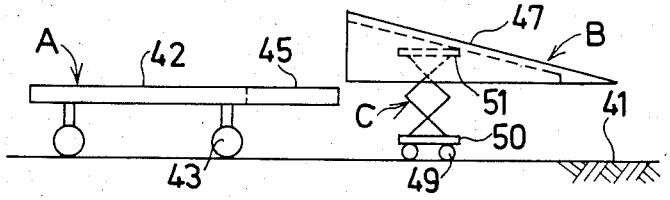

In connection with the manner of dismantling and collapsing and placing, at the work base, the module $C_1$ onto the module $B_1$ of the bridge structure, while there are known adaptable and typical types such as a hinged type, a sliding type, and the like, as these types generally turn out to be complicated in construction and time-taking in explanation, it is preferred for clarity that only a simple construction having steady and stable lift system is therefore taken for example. Referring to FIG. 8, it is seen that the table lift 28 incorporated in the module $C_1$ (see FIG. 5) is initially extended to the working position so that the bottom surface of the module $C_1$ may be lifted higher than the top surface of the ground plate 17 of the module $B_1$. Next, after removing the detachable ground plate 24 from the module $B_1$, the table lift 28 is moved into a space opened after the removal of the ground plate 24 (see FIG. 7), and then the table lift 28 is let closed to a position where an end of the bottom of the module $C_1$ would rest upon the top surface of the ground plate 17, thereafter having the jack 25 in the ground plate 17 operated so that the bottom of the module $C_1$ may be supported duly, and then having the table lift 28 retracted into a position in the module $C_1$ (see FIG. 8). After this procedure, the jack 25 is lowered to a position where the bottom of the module $C_1$ may rest upon the ground plate 17 (see FIG. 9), and then lifting the module $C_1$ upwardly onto the ground plate 17 (see FIG. 10) by using a chain block or the like so that the outrigger 22 may be retracted from the working position, which is the completion of the collapsing job to be performed prior to the hauling by the tractor 29 to a working site.

Then, the module $A_1$ is, upon the retraction of the outrigger 8, driven from the rear cockpit 6 over to a working site.

On the other hand, each of the modules $A_2$, $B_2$ and $C_2$ is prepared for the delivery service by retracting the outrigger 8 and by having the front cockpit 7 shifted toward the leading end position 7' of the overhung portion 1*a* by means of the drive 11. The the module $C_2$ is also mounted onto the module $B_2$ in the similar manner to the modules $B_1$ and $C_1$, thereafter being coupled with the module $A_2$ by way of the couplers 23, 23'. Then, the front cockpit 7' operates to drive the module $A_2$ so that the module $B_2$ may be hauled over to a working site.

Now referring to the working operation at a repair site, the modules $A_1$ and $B_1$ are coupled together by using the coupler 23. This coupling operation is done through the rear cockpit 6 for driving the module $A_1$ coupled rigidly with the module $B_1$ so that the module A1 may move relatively with respect to the module $B_1$. In connection with this operation, since the module $A_1$ is designed to be operable in skewing and centered-turning motions in addition to the forward and rearward motions, this approaching operation may be performed with ease. Next, the module $A_1$ is driven from the front cockpit 7 in such a manner that the coupler 12 may be set at a position immediately upon an area of the road 30 to be repaired and that the modules $A_1$ and $B_1$ may be located in the middle of the width of the road, where the tractor 29 is then disengaged from the modules. After the modules $A_1$ and $B_1$ are set in the duly position, the module $A_2$ is then driven from the front cockpit 7 so that it may be coupled to the module $A_1$ by using the coupler 12. It is like the case of the modules $A_1$ and $B_1$ that the modules $A_2$ and $B_2$ are adjusted as close as possible to the center of the width of the road to be repaired. Then, the relative location of these modules $A_1$ and $A_2$ may be corrected with a further adjustment, thereafter the outriggers 8 and 22 being extended towards the road surface where they rest securely upon, the modules $C_1$ and $C_2$ being loweredonto the road surface in the reverse order, then coupled with the modules $B_1$ and $B_2$ by coupling means (not shown), respectively. With this sequence of operations, there may duly be located the built-up bridge structure in the right position on the road surface 30 to be repaired, with the due work space 31 under the overhung portions 1*a*, 1*a* of the pair of modules $A_1$ and $A_2$, accordingly.

Figure 2:
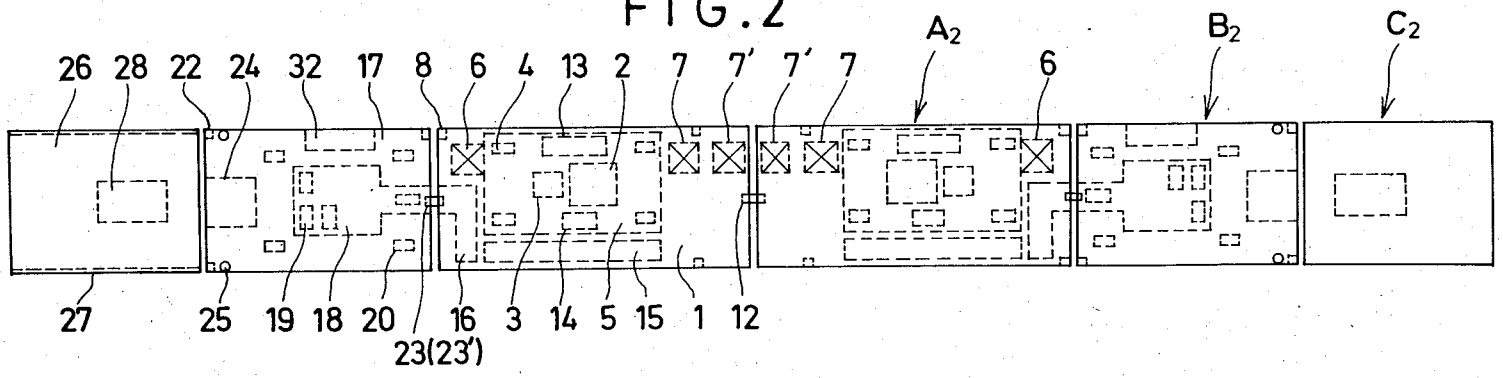
FIG. 2 is a top planar view showing the bridge structure shown in FIG. 1.

Upon the completion of installation of the bridge structure, a repair work is then started, which will now be described in detail referring to FIGS. 1 and 2. In the case that an expansion joint under the ground is repaired, in order to firstly remove the concrete portion where the joint is located, the concrete portion is cut away by using a concrete cutter (not shown), thereafter it being broken to pieces by way of a concrete breaker (not shown). Thus-broken concrete scraps and the expansion joint are placed into the housing box 19 so as to be delivered onto the free-action bearing 18 on the modules $B_1$, and $B_2$ by using the roller conveyor 15 and the free-action bearing 16.

The opening left upon the removal of concrete is then cleaned so that it may be filled with fresh concrete. The concrete work is then done in such a manner that cement, sand and aggregate which are stored beforehand in the storing box 19 on the free-action bearing 18 are fed into a concrete mixer (not shown) located on a work space by using the free-action bearing 16 and the roller conveyor 15, and then they are kneaded with water supplied from the water tank 32 on the part of the modules $B_1$ and $B_2$. After the concrete is placed and cured, there is set a new expansion joint thereupon, thus completing the reparation work.

While there are not shown in drawings such portable members as a concrete cutter, a concrete breaker, a mixer and the like which are generally used in the reparation work, it is notable that they are stored in suspension from the ground plate 1 in the work space defined between the modules $A_1$ and $A_2$ in such a manner that they are serviceable taken out of such a stored condition, and that these members are put to use with the utilities such as compressed-air and the power from the compressor 13 and the power generator 14.

As stated hereinbefore, after the reparation work is over, the modules $B_1$, $B_2$ and the modules $C_1$, $C_2$ are disengaged from each other in the like initial sequence as done in the work base, thereafter the modules $C_1$, $C_2$ being mounted onto the modules $B_1$, $B_2$, respectively. Also, the joint between the modules $A_2$ and $B_2$, and between the modules $A_1$ and $A_2$ are then released, with the front cockpit 7 being shifted toward the position 7' on the part of the module $A_1$ and with all the outriggers 8 and 22 retracted, and then the module $B_2$ is ready for the hauling service by the tractor 29, while the module $A_2$ is driven from the rear cockpit 6 and the module $A_1$ is driven from the front cockpit in the position 7', together with the module $B_1$ ready for a return to the work base.

Now, as reviewed fully with reference to the embodiment as shown, it is appreciated that there may be attained the work space 31 under both overhung portions 1*a*, 1*a* by coupling the pair of modules $A_1$, $A_2$, equipped with the ground plate 1 having the overhung portion 1*a* extending from the leading end thereof, in an opposed relationship with each other, and there is obtainable a due strength of the ground plate 1 by virtue of the employment of such integral construction as noted hereinbefore, thus making such an overhung structure feasible in practice. In addition, possible poor visibility of the cockpit that is otherwise inevitable from the overhung structure may be eliminated by virtue of the advantageous construction that the front cockpit 7 of the modules $A_1$, $A_2$ may be shifted in location along the extension of the overhung portion 1*a*.

Also, it is advantageous that the modules $A_1$, $A_2$ and the modules $B_1$, $B_2$ are designed in an optimal manner of division so that these modules may readily be delivered to services or removed out of a working site due to the unique coupling features that can provide such a releasable joint between these modules as stated hereinbefore.

Furthermore, the modules $C_1$, $C_2$ can efficiently be loaded onto and unloaded from the modules $B_1$, $B_2$ by virtue of the incorporation of the table lift 28 without the need for a complicated and cumbersome lifting device.

Still further, each of the divisional elements, owing to the unique separation in construction of the modules $A_1$, $A_2$, $B_1$, $B_2$ and $C_1$, $C_2$, can travel by way of normal roads without any restrictions under the traffic regulations, accordingly.

Figure 11:
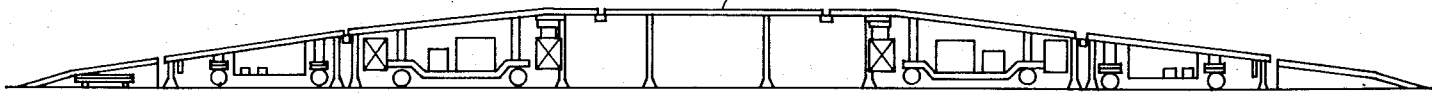
FIG. 11 is a side elevational view showing, by way of a second embodiment of the invention the built-up bridge structure.
Figure 5:
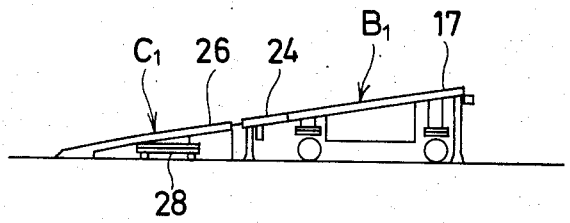
FIGS. 5 through 10 are side elevational views showing a sequence of translating a ramp block onto a ramp segment of the bridge structure.
Figure 6:
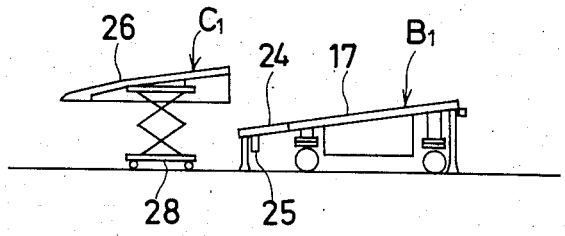
Figure 7:
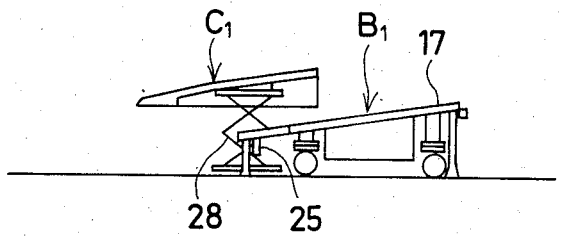

Moreover, it is feasible in practice to insert a space module D as shown in FIG. 11 for the attainment of a further work space under the bridge structure. In such an added organization, the space module D may be either of the self-propelled type or of the hauling type.

Now, referring to FIGS. 12 through 21, there will be described by way of preferred embodiments of the invention an improved translating apparatus which is adapted to translate the ramp block onto the movable bridge element.

In the drawings, there is shown the ground 41 upon which the bridge structure rests, a bridge element at A, and a set of wheels 43 carried under ground plate 42 of the element A. Also, there is disposed a set of outriggers 44 under the ground plate 42, and a detachable gound segment 45 which forms part of the ground plate 42 in the middle of a rear edge portion thereof. In addition, there is provided rotatably a plurality of steel balls 46 along the extension of right and left sides of the ground plate 42 in such a manner that their upper halfs are exposed above the side edges.

Also shown is a ramp block B defined in the form of a gate in cross section having leg wall portions 48 extending from both side edges of the ground plate 47 where there is provided no wheels, and which is designed to rest upon the ground by way of these wall portions 48.

There is shown a lift at C in which there is disposed expandably a lift table 51 supported on lift base 50 having a set of wheels 49. Lift table 51 is connected rigidly to the bottom surface of the ground plate 47 in such a manner the wheels 49 do not reach the ground 41, when the lift C is retracted. It is notable that the lower end of the wall portion 48 is thickened so that there may be provided a pair of linear grooves 52 extending in the longitudinal direction, which engage with the steel balls 46 provided on the ground plate 42 during loading of ramp block B onto bridge element A.

With such construction as shown by way of this embodiment, after the bridge assembly A with ground plate 42 and ground plate 47 of the ramp block B are disengaged from each other, and when the lift table 51 of the lift C is extended, the wheels 49 of the lift base 50 will the ground 41. Thereafter, the ground plate 47 is elevated by lift table 51. When the bottom surfaces of the wall portions 48, having linear grooves 52 therein, becomes higher than the tops of the steel balls 46 as provided in the ground plate 42 on the part of the bridge assembly A, elevating the lift table 51 is then stopped (see FIGS. 16 and 17).

Figure 18:
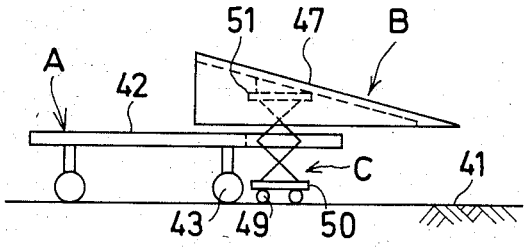
Figure 19:
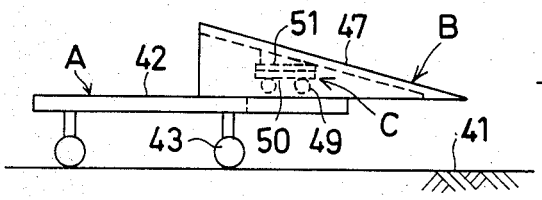
Figure 20:
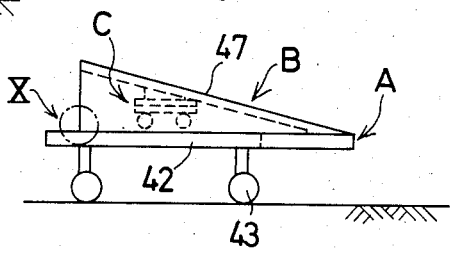
Figure 21:
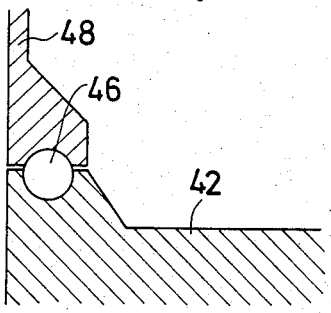
Figure 23:
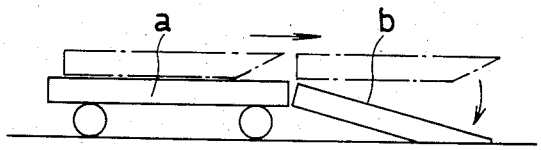
FIG.23 (PRIOR ART)
FIGS. 22 and 23 are side elevational views showing respectively the general constructions of the conventional movable bridge structures.
Figure 22:
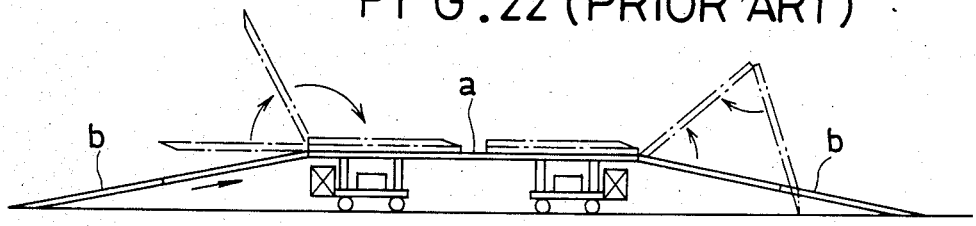
FIG.22 (PRIOR ART)

Next, after the removal of the detachable ground segment 45 of the ground plate 42 on the part of the bridge assembly A, the lift C is drawn toward the assembly A by using a suitable pulling means (not shown) so that it may be positioned into the opening or space left open after removing the detachable section 45 (see FIG. 18).

When the lift table 51 is retracted slowly there will occur mutual engagement between the linear grooves 52 in the ramp block B and the steel balls 46 on ground plate 42 of the bridge assembly A. Whereupon the ground plate 47 is then held in a loading position on the ground plate 42, accordingly. When the lift table 51 is retracted further from this loading position, the lift base 50 and the wheels 49 are lifted upwardly towards the lift table 51, eventually retracted in position on the ramp block B (see FIG. 19). Then, the ground plate 47 of the ramp block B is moved, by using a suitable pulling means (not shown), so that ground plate 47 may be disposed completely in a proper resting position on the ground plate 42 of the bridge assembly A, accordingly.

During the pulling stage, the steel balls 46 and the linear grooves 52 are put in a close engagement relationship with each other, which will then make it possible to pull ground plate 47 with relatively small pulling effort and which will also ensure proper alignment or orientation of traveling motion of the ground plate to be stored.

Upon the completion of such loading operation, the ground plates 42, 47 are fixed in the resting position by using certain suitable means not shown, and then the outriggers 44 are retracted accordingly in preparation for the following transportation step.

Now, it will be observable that the bridge assembly A and the ramp block B are to be set in working position following the unloading procedures in the reverse order, upon arrival at a next working spot.

It is to be understood by those skilled in the art that a plurality of element blocks of identical type may be adapted for use in field operations.

In summary, it is now seen that it is feasible in practice according to the preferred embodiments of the invention to have the bridge structure constructed and collapsed readily without any further provision than the lift C incorporated in the ramp block B and to have an advantageous low-friction and high-linearity traction performance in the loading and unloading motions of the ramp block B by virtue of the employment of a positive and smooth ball-and-groove engagement between the bridge assembly A with ramp segment 42 and ramp segment 47 of the ramp block B.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A mobile bridge structure having a plurality of ramp modules including at least one truck ramp module, said ramp module comprising:

a plurality of wheel members;

a frame means, of a predetermined length, operatively connected to said wheel members;

a prime mover operatively connected to said plurality of wheels for propelling the at least one ramp module;

a ramp means operatively connected to said frame means and extending beyond the predetermined length of said frame means forming an overhung portion;

a first operator cockpit, having driving and operating means for driving and operating at least one truck ramp by an operator, said first operator cockpit means being slidably suspended from said overhang portion of said ramp plate for providing repositioning of said first operator cockpit from a first position, at which an operator has adequate visibility for driving the truck ramp, to a second position for providing adequate working space under the truck ramp.

2. The at least one truck ramp according to claim 1, including a second operator cockpit, having driving and operating means for driving and operating the at least one truck ramp, operatively connected to said frame means at a location of the opposite end of the at least one truck ramp at which said first operator cockpit is slidably suspended.

3. The at least one truck ramp module according to claim 1, including coupling means located at both ends of the at least one truck ramp module for connecting the at least one truck ramp module to other ramp modules.

4. The at least one truck ramp module according to claim 2, including coupling means located at both ends of the at least one truck ramp module for connecting the at least one truck ramp module to other ramp modules.

5. A mobile bridge structure having a plurality of modular ramp units containing ramp means, at least one of said ramp units containing a self propelling means, the majority of said ramp units containing wheel members, said ramp units comprising a support structure for supporting said ramp means, said self propelling means containing at least one operator cockpit slidably suspended from said ramp means, whereby said operator cockpit is movable from a position at the end portion of the ramp means to a position removed from said end portion to provide space beneath the mobile bridge structure.

* * * * *